US011337470B2

(12) United States Patent
Mazzarolo et al.

(10) Patent No.: US 11,337,470 B2
(45) Date of Patent: May 24, 2022

(54) MULTI-COMPONENT GARMENT

(71) Applicant: Alpinestars Research S.p.A., Maser (IT)

(72) Inventors: Giovanni Mazzarolo, Coste di Maser (IT); Sergio Conte, Valstagna (IT)

(73) Assignee: ALPINESTARS RESEARCH S.P.A., Maser (IT)

( * ) Notice: Subject to any disclaimer, the term of this patent is extended or adjusted under 35 U.S.C. 154(b) by 525 days.

(21) Appl. No.: 15/031,470

(22) PCT Filed: Oct. 22, 2014

(86) PCT No.: PCT/IB2014/065531

§ 371 (c)(1),
(2) Date: Apr. 22, 2016

(87) PCT Pub. No.: WO2015/059645

PCT Pub. Date: Apr. 30, 2015

(65) Prior Publication Data

US 2016/0295939 A1 Oct. 13, 2016

(30) Foreign Application Priority Data

Oct. 24, 2013 (IT) ..... TV2013A000176

(51) Int. Cl.
*A41D 15/00* (2006.01)
*A41D 13/05* (2006.01)
(Continued)

(52) U.S. Cl.
CPC ..... *A41D 15/00* (2013.01); *A41D 1/04* (2013.01); *A41D 3/00* (2013.01); *A41D 13/0556* (2013.01);
(Continued)

(58) Field of Classification Search
CPC ..... A41D 1/04; A41D 3/00; A41D 13/0556; A41D 15/00; A41D 2600/102
See application file for complete search history.

(56) References Cited

U.S. PATENT DOCUMENTS 4,103,361 A * 8/1978 Carmen ..... A41D 3/00 2/97
4,502,153 A * 3/1985 Lapedes ..... A41D 27/02 2/81
(Continued)

FOREIGN PATENT DOCUMENTS

WO 2013106332 A1 7/2013

OTHER PUBLICATIONS

PCT International Search Report and Written Opinion dated Feb. 5, 2015 from International Application No. PCT/IB2014/065531, from which the instant application is based, 11 pgs.
(Continued)

*Primary Examiner* — Jocelyn Bravo
(74) *Attorney, Agent, or Firm* — Fredrikson & Byron, P.A.

(57) ABSTRACT

Relating to a multi-component garment including a first outer component, provided with first fixing; a second inner component for providing protection against knocks and/or falls, provided with second fixing; and a third, inner, thermal insulation component provided with third fixing. The first, second and third fixing are designed to cooperate with each other so as to allow selective mutual fixing of at least: (a) the first outer component and the second inner component, (b) the first outer component and the third inner component and (c) the first outer component, the second inner component and the third inner component to each other.

20 Claims, 6 Drawing Sheets

(51) Int. Cl.
*A41D 27/04* (2006.01)
*A41D 3/00* (2006.01)
*A41D 1/04* (2006.01)

(52) U.S. Cl.
CPC ..... *A41D 27/04* (2013.01); *A41D 2600/102* (2013.01)

(56) References Cited

U.S. PATENT DOCUMENTS 4,768,233 A * 9/1988 Grilliot ..... A41D 13/005 2/81
4,864,656 A 9/1989 Nesse
4,987,613 A 1/1991 Loverdi et al.
4,999,850 A * 3/1991 Grilliot ..... A41D 13/00 2/126
5,077,838 A * 1/1992 Senser ..... A41D 15/00 2/102
5,136,723 A * 8/1992 Aldridge ..... A41D 13/00 2/81
RE35,682 E * 12/1997 Fields ..... A41D 27/10 2/123
5,718,000 A * 2/1998 Ost ..... A41D 3/00 2/69
6,029,270 A 2/2000 Ost et al.
6,070,274 A 6/2000 van der Sleesen
6,263,510 B1 * 7/2001 Bay ..... A41D 27/28 2/108
6,339,843 B1 * 1/2002 Grilliot ..... A41D 27/04 2/97
6,728,970 B1 * 5/2004 Grilliot ..... A41D 13/00 2/81
6,806,215 B2 * 10/2004 Grilliot ..... A41D 31/0027 428/920
6,851,128 B1 2/2005 Parrotte
6,961,962 B1 * 11/2005 Lewis ..... A41D 13/0002 2/81
7,111,328 B2 * 9/2006 Bay ..... A41D 3/00 2/86
7,168,097 B2 * 1/2007 Grilliot ..... A41D 13/00 2/81
RE39,698 E * 6/2007 Grilliot ..... A41D 13/00 2/81
2002/0174476 A1 * 11/2002 Cochran ..... A41D 27/04 2/97
2004/0181843 A1 * 9/2004 Grilliot ..... A41D 13/00 2/81
2005/0235392 A1 * 10/2005 Bay ..... A41D 3/00 2/93
2008/0040832 A1 * 2/2008 Bay ..... A41D 27/28 2/93
2008/0263744 A1 * 10/2008 Di Giovanni ..... A41D 31/0027 2/81
2012/0260396 A1 * 10/2012 Mordecai ..... A41D 31/06 2/97

OTHER PUBLICATIONS

Search Report and Written Opinion dated Jul. 3, 2014 for related IT Application No. TV20130176, 7 pgs.

* cited by examiner

MULTI-COMPONENT GARMENT

RELATED APPLICATIONS

This application is a 35 U.S.C. 371 national stage filing from International Application No. PCT/IB2014/065531, filed Oct. 22, 2014, which claims priority to Italian Application No. TV2013A000176, filed Oct. 24, 2013, the teachings of which are incorporated herein by reference.

FIELD OF THE INVENTION

The present invention relates to a multi-component garment. In particular, even though not exclusively, the present invention relates to a multi-component garment suitable for use by motorcyclists.

BACKGROUND

Garments comprising two or more components suitable for being combined with each other in order to obtain different configurations for use of the garment are known.

For example, jackets comprising an outer component, suitable for protecting the user from wind and rain, are known where an inner lining suitable for protection against the cold is removably fixed to said outer component.

The outer component and the inner lining may be used in combination with each other or may be used separately depending on the uses and the external climatic conditions.

These garments, although widely appreciated for their versatility, are not specifically designed to be used by a motorcyclist. In fact, they are not provided with specific protection means designed to protect the parts of the body of a motorcyclist which are most prone to injury, for example the shoulders, back and elbows.

Also known from U.S. Pat. No. 6,070,274 is a multi-layer garment designed to be worn by a motorcyclist. This garment comprises an outer panel, made of leather or similar materials, an elastic inner lining fixed to the outer panel along the outer edges of the latter and one or more protection elements fastened in a permanent or removable manner to the lining, between the lining itself and the inside of the outer panel.

This garment offers, owing to the presence of the protection elements, increased protection against knocks or falls, although it is less versatile than the garments described above since it does not allow use of the lining separate from the outer panel. Moreover, in order to obtain a "lighter" configuration of the garment it is possible to remove the protection elements from the respective seats, but this operation is somewhat complex and slow to perform.

BRIEF SUMMARY OF EMBODIMENTS OF THE INVENTION

The object of the present invention is to overcome at least partially the drawbacks mentioned above with reference to the prior art.

A first task of the present invention is to provide a multi-component garment which may be easily used in different configurations and which at the same time may offer an improved protection to a motorcyclist against knocks and/or falls.

A second task of the present invention is to provide a multi-component garment provided with protection elements which may be easily removed so as to be able to change easily from a configuration more suitable for use on a motorcycle to a lighter configuration more suitable for not strictly motorcycling use.

A third task of the present invention is to provide a multi-component garment, the components of which may be easily fixed together.

Yet another task of the present invention is to provide a multi-component garment which may ensure suitable protection for a motorcyclist against knocks and/or falls without excessively restricting his/her movements.

Finally, a further task of the present invention is to provide a multi-component garment which, during all the configurations of use, is able to ensure suitable comfort and greater protection for the user.

The abovementioned object and tasks are achieved with a multi-component garment according to claim 1.

BRIEF DESCRIPTIONS OF DRAWINGS

The characteristic features and further advantages of the invention will emerge from the description, provided hereinbelow, of a number of examples of embodiment, provided by way of a non-limiting example, with reference to the accompanying drawings in which.

DETAILED DESCRIPTION OF EMBODIMENTS OF THE INVENTION

Figure 1:
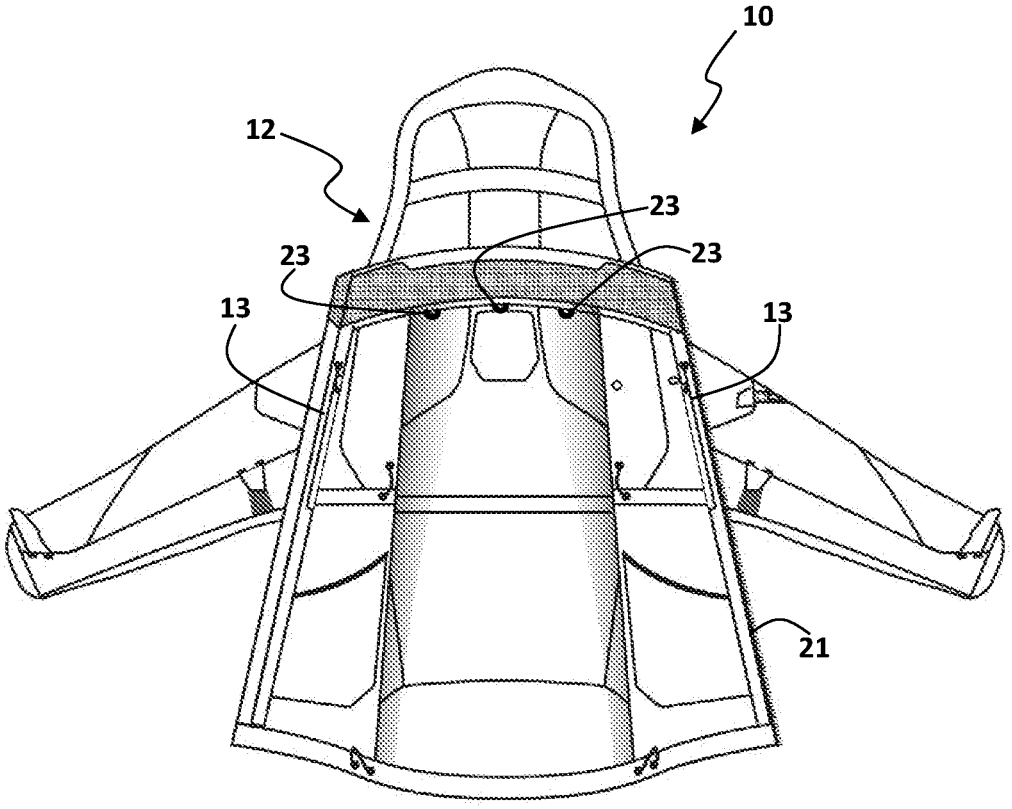
FIG. 1 shows in schematic form a front view, in an open configuration, of a first component of the multi-component garment according to the invention.

The description below refers to a multi-component garment which can be used in all those fields where both suitable protection against knocks and/or falls and an excellent degree of comfort are required and where advantageously it is possible to change from a "heavy" configuration, providing greater protection, to a "lighter" configuration, without specific protection, and vice versa.

For example a garment made in accordance with the innovative principles of the present invention may be advantageously used by motorcyclists, cyclists and skiers.

In the description which follows, for greater illustrational clarity, reference will be made to a multi-component garment suitable for use by a motorcyclist.

Furthermore, "inner" will be used to indicate the part or component of the garment which, during normal use, is relatively closer to the user's body and "outer" will be used to indicate the part or component which is relatively more distant.

With reference to the accompanying figures, a multi-component garment made in accordance with the principles of the present invention is indicated by 10.

The multi-component garment 10 comprises a first outer component 12 provided with first fixing means 13, 23; a second inner component for protection against knocks and/or falls 14, referred to below simply as second component 14, provided with second fixing means 15, 16, 17, 18; and a third, inner, thermal insulation component 19, referred to below simply as third component 19 and provided with third fixing means 20, 29.

In accordance with the invention, the first, second and third fixing means are designed to cooperate with each other so as to allow selective mutual fixing of at least: (a) the first outer component 12 and the second component 14, (b) the first outer component 12 and the third component 19 and (c) the first outer component 12, the second component 14 and the third component 19 to each other.

As will become clear from the description below, the second fixing means 15, 16, 17, 18 of the second component 14 and the third fixing means 20, 29 of the third component 19 are designed to cooperate with each other so as to allow fixing together of the second component 14 and the third component 19.

Moreover, the second fixing means 15, 16, 17, 18 and the third fixing means 20, 29 are designed to cooperate with the first fixing means 13, 23 of the first outer component 12 so as to allow removable fixing of the second component 14 and the third component 19 to the first outer component 12.

Preferably, the multi-component garment 10 according to the invention consists of a jacket designed to cover at least the torso and arms of the user. According to alternative embodiments of the invention, which are not shown in the accompanying figures, but may be easily imagined by a person skilled in the art, the multi-component garment 10 may consist, for example, of a three-quarters length jacket, a vest, a suit or a pair of trousers.

With specific reference to FIG. 1, the first outer component 12 is preferably made using impermeable and breathable material.

This outer component 12 may be designed to protect the user from wind and rain and ensure suitable heat regulation of the body.

The outer component 12 may comprise a front opening arranged preferably in a central position and closed in a known manner by means of a zip fastener 21 or by means of snap-fit buttons.

Different embodiments of the means for closing the front opening are, however, possible in order to satisfy different requirements.

Advantageously, the provision of a front opening provided with independent closing means allows the user to put on easily the outer component 12 and close it around one's body independently of the presence of other components of the garment 10.

In order to allow fixing of the outer component 12 to the second component 14 and/or to the third component 19, the outer component 12 is provided on its inner surface with first fixing means 13, 23.

Said first fixing means comprise preferably first connection means 13 arranged on the sides of the front opening of the outer component 12. Preferably, said first connection means 13 consist of two halves of a zip fastener, i.e. two rows of teeth. Each row of teeth is positioned in the vicinity of one of the edges of the front opening and is designed to be fixed to another half of a corresponding zip fastener.

As shown in FIG. 1, the first connection means 13 are positioned on the inner surface of the outer component 12 which, during use, is arranged over the user's torso.

The means for fixing the outer component 12 further comprise additional connection means 23 by means of which the outer component 12 may be removably fixed to the second component 14 or to the third component 19.

Preferably, the additional connection means 23 of the outer component 12 are positioned at the terminal ends of the sleeves (see FIGS. 5 and 6) or on the inner surface of the outer component 12 which, during use, is designed to cover the shoulders and the neck of the user (see FIG. 1). Preferably, these additional connection means 23 comprise releasable loops provided at their ends with snap-fit closing means or may consist of fixing rings made using a lace or a strip of elastic material.

Figure 3:
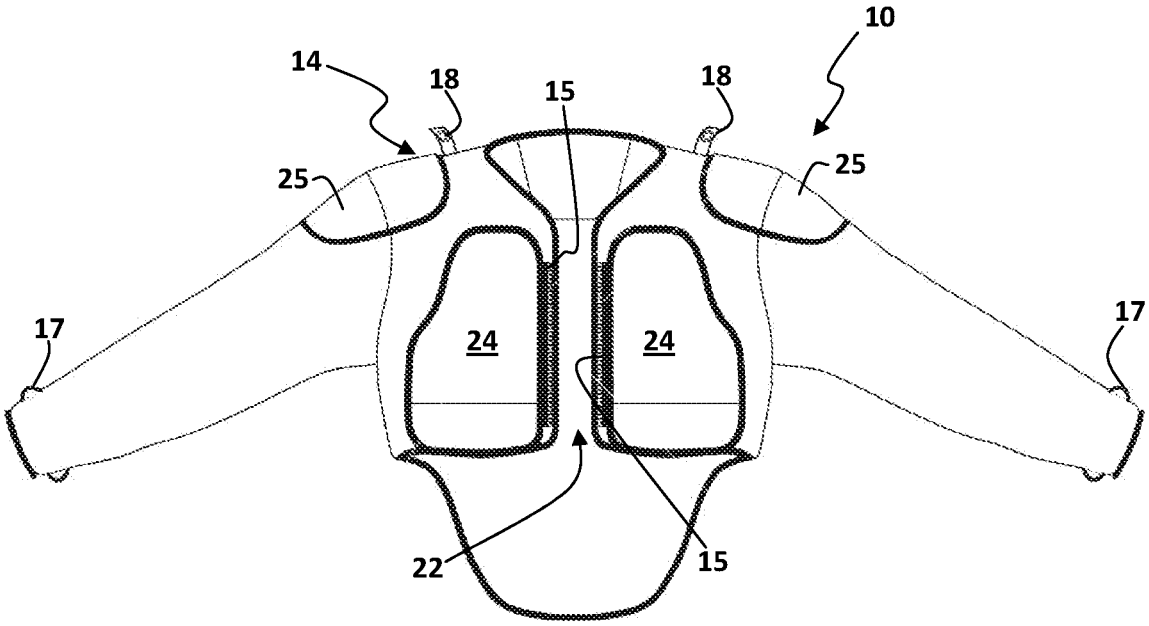
FIGS. 3 and 4 show, respectively, a front view and a rear view of a third component of the multi-component garment according to the invention.
Figure 4:
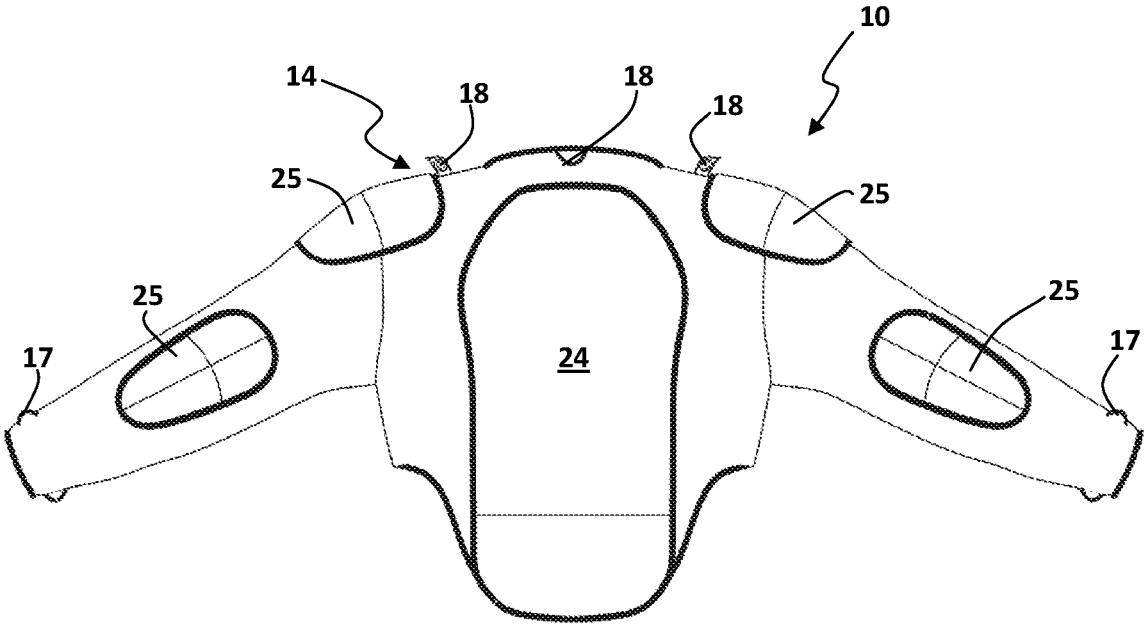

With reference to FIGS. 3 and 4, the second component 14 is a component suitable for providing protection against knocks and/or falls.

Preferably, the second component 14 is made with a fabric having a small thickness, preferably less than 1 mm, which ensures a high degree of flexibility and small dimensions, such as mesh fabric. This flexible thin fabric is able to adapt easily to the user's body.

Furthermore, in the case where it is made of mesh, a certain degree of breathability is ensured, despite its supporting function, as will be explained below, for the elements providing protection against knocks and/or falls.

In the embodiment shown, the second component 14 is designed to cover at least the arms, the back and the torso of the user. Alternative embodiments are, however, possible in order to satisfy specific protection requirements. For example, the sleeves of the second component 14, which in the accompanying figures have a length substantially the same as that of the sleeves of the outer component 12, may have a smaller length.

As shown in FIG. 3, the second component 14 may comprise a front opening 22 arranged preferably in a central position.

The second component 14 is provided with second fixing means 15, 16, 17, 18.

These second fixing means allow the second component 14 to be easily fixed to the outer component 12 and/or to the third component 19.

The second fixing means comprise second connection means 15 which are designed to cooperate with the first connection means 13 of the first outer component 12.

In the embodiment shown, these second connection means 15 are arranged on the sides of the front opening 22 of the second component 14 on the outer surface of the latter.

Preferably, the second connection means 15 consists of two rows of teeth of a zip fastener. Each row of teeth is positioned in the vicinity of one of the edges of the front opening 22 and is designed to be removably fixed to another half of a corresponding zip fastener, in particular to the corresponding half of the zip fastener of the first connections means 13.

Figure 6:
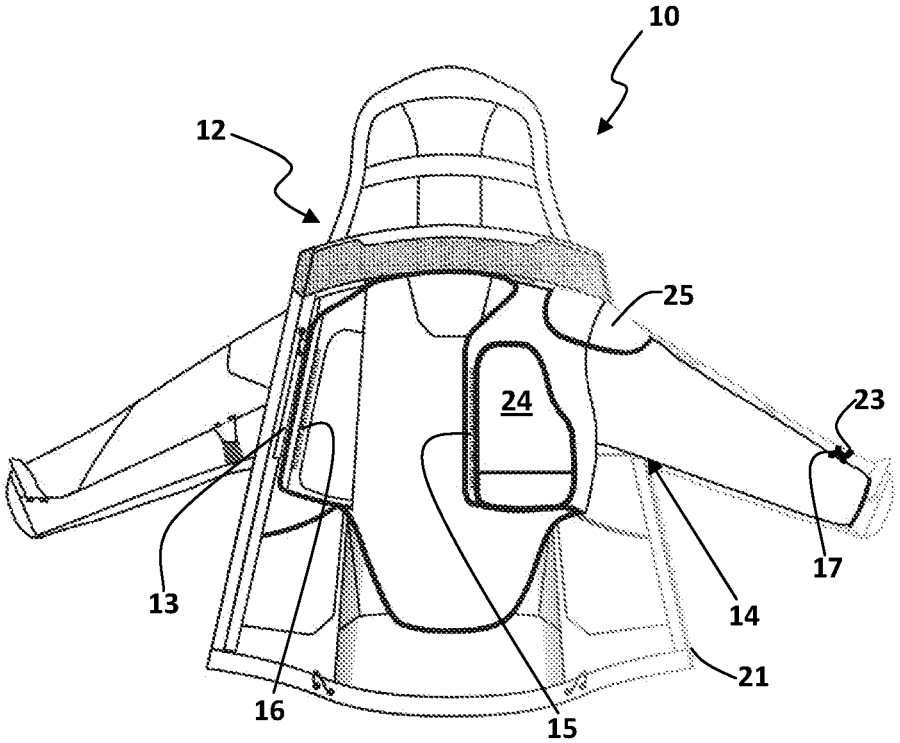
Figure 9:
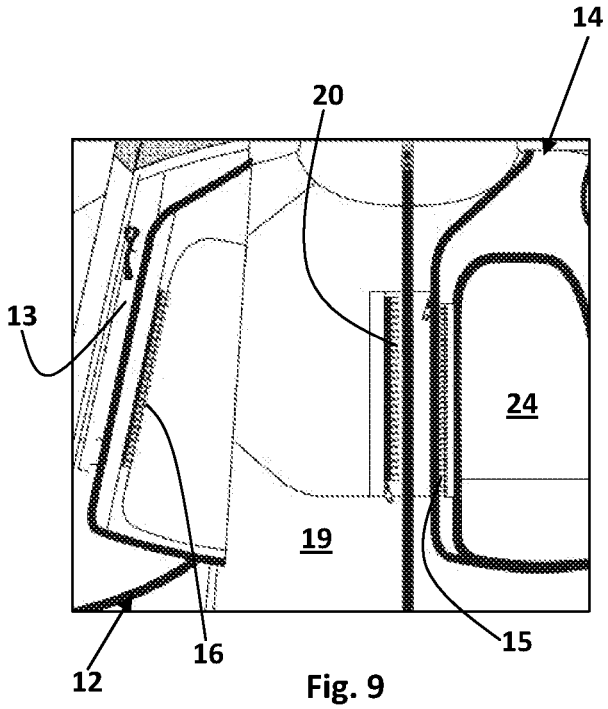
FIG. 9 shows a view, on a larger scale, of the detail indicated by A in FIG. 8.

Via the first connection means 13 and the second connection means 15, therefore, the second component 14 may be removably fixed to the outer component 12 (see FIGS. 6 and 9).

Figure 8:
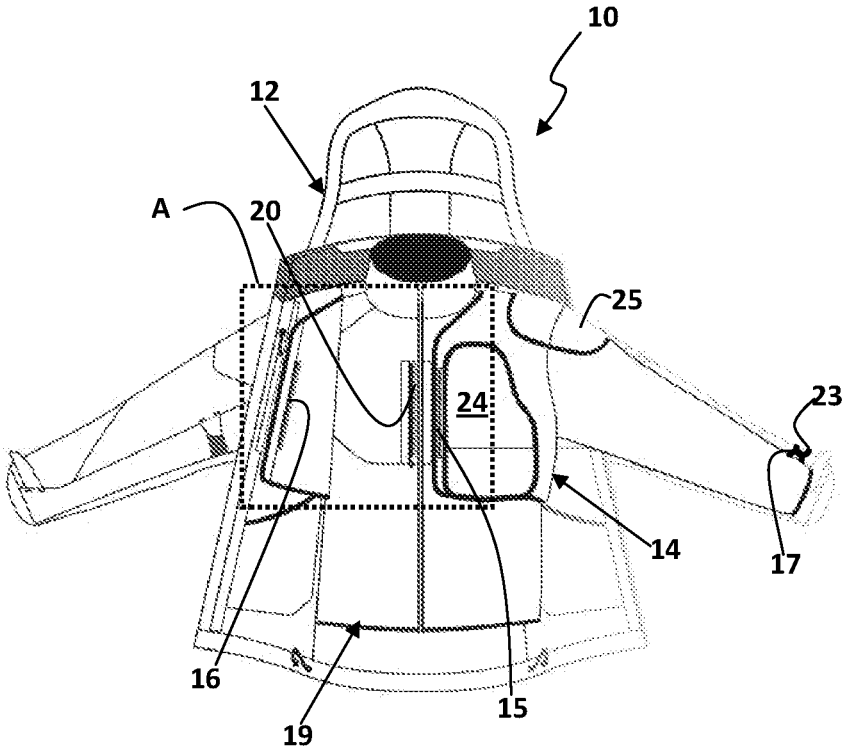
FIG. 8 shows a view, similar to that of FIG. 5, where the fixing means of the respective components of the multi-component garment according to the invention can be seen.

The second fixing means further comprise third connection means 16 (see FIGS. 6, 8 and 9).

Said third connection means 16 preferably consist of two rows of teeth, each of which is positioned on the sides of the front opening 22 on the inner surface of the second inner component 14.

As will become clear from the following description, via the third connection means 16 the second component 14 may be removably fixed to the third component 19 of the garment 10.

In the embodiment shown, the second fixing means of the second component 14 further comprise loops 17 arranged at the terminal ends of the sleeves.

These loops 17 are designed to cooperate with the connection means 23 of the first outer component 12 so as to allow removable fixing of the sleeves of the second component 14 to the sleeves of the first outer component 12, once the sleeves of the second component 14 have been inserted inside the sleeves of the first outer component 12. In a known manner, as already mentioned, the loops 17 and the connection means 23 may consist of releasable strips. These strips, once opened owing to the presence of suitable closing means (for example snap-fit closing means and/or Velcro® closing means), are inserted inside each other so as to be then closed in order to ensure connection together.

Different closing means for the strips may obviously be provided.

Similarly, the second component 14 is provided with further loops 18, which are preferably releasable and designed to cooperate with the connection means 23 of the first outer component 12 positioned on the shoulder and/or neck portion. The loops 18 therefore allow the shoulder and neck portion of the second component 14 to be removably connected to the first outer component 12, once the second component 14 has been inserted inside the first component 12.

The second component 14 is provided with seats 24, 25 which are designed to house removably protective padding elements and/or semi-rigid protection elements.

In the embodiment shown in the accompanying figures, the protective padding elements are housed inside seats 24 arranged respectively on the portions of the second component 14 designed to be positioned during use over the back and torso of the user. These protective padding elements are preferably made of expanded polymer material.

The semi-rigid protection elements, in turn, are preferably housed inside seats 25 arranged respectively on portions of the second component 14 designed to be positioned during use over the elbows and shoulders of the user. These semi-rigid protection elements may be made of dense polymer material and may have slits for assisting ventilation also of the portions of the garment which are provided with protection elements.

Preferably, the semi-rigid protection elements are made of polypropylene and may be internally lined with a padding layer consisting of polyurethane foam or similar materials.

The seats 24, 25 consist preferably of pockets provided on the outer or inner surface of the second component. These pockets have preferably an opening closed by releasable closing means so that, if necessary, the various padding elements and protection elements may be removed from the second component 14.

The application of the padding and the semi-rigid protection elements on the second component 14 of the garment 10 ensures on the one hand that these protection elements during their use remain in the correct position of use, thus ensuring suitable protection of the part of the body to which they are applied.

On the other hand, since they are fixed to a flexible and thin material, these protective elements may adapt better to the anatomy of the user's body, being substantially independent of each other. The backing fabric, in fact, in particular if made of mesh, precisely because of its technical characteristics, is not bulky and does not limit excessively the movements of the user.

The second component 14 may also be provided with protection elements of the inflatable type, able to move from a rest condition, where they are in a deflated condition, to an operative condition, where they are in an inflated state. The activation of these protection elements, in a known manner, is performed when the electronic control unit which monitors the user's behaviour, by means of suitable sensors positioned on the garment, detects a danger situation.

Figure 2:
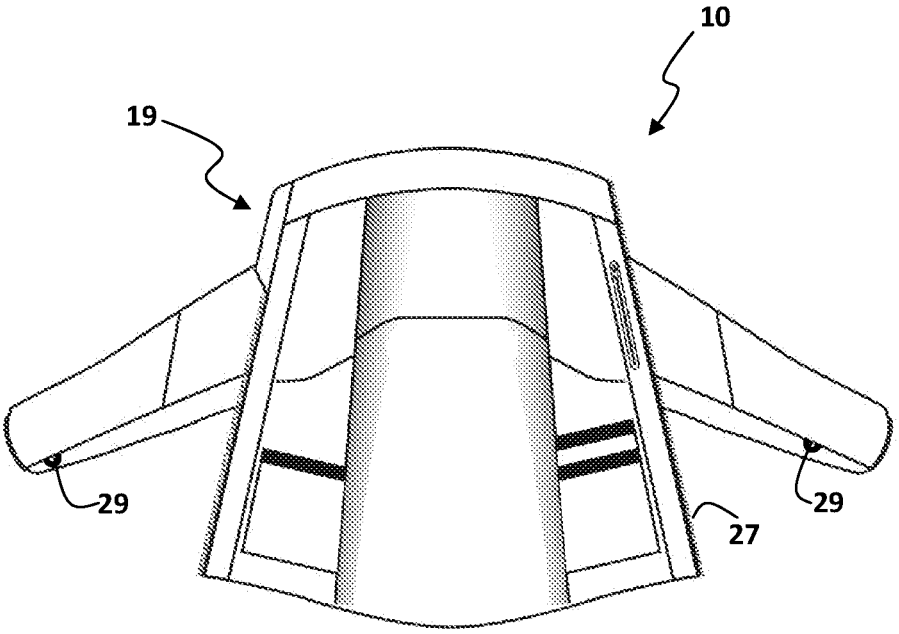
FIG. 2 shows a view, similar to that of FIG. 1, but relating to a second component of the multi-component garment according to the invention.

With reference now to FIG. 2, the third component 19 is a component designed to provide effective thermal insulation, i.e. able to protect the user against cold.

Preferably, the third component 19 is made using a dual-layer, soft, synthetic fabric which is padded with wadding and/or feathers. Preferably, the third component 19 is made using nylon fibres or similar materials.

In the embodiment shown, the third component 19 is designed to cover at least the arms, the back and the torso of the user. Alternative embodiments are, however, possible in order to satisfy specific protection requirements. For example, the third component 19 may be a vest.

Figure 7:
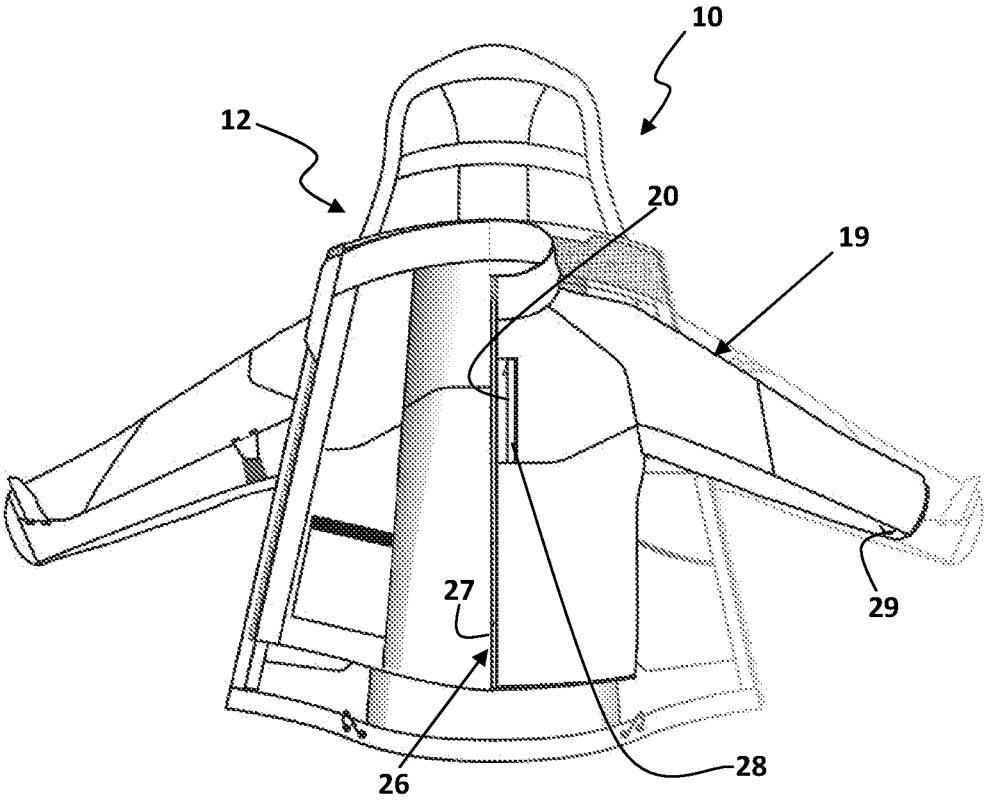

As shown in FIGS. 2 and 7, the third component 19 may comprise a front opening 26 arranged preferably in a central position and closed by means of a zip fastener 27 or by means of snap-fit buttons or other equivalent closing means.

Advantageously the third component 19, since it is provided with closing means independent of those of the other components 12, 14 of the garment 10, may be worn on its own, without having to be necessarily fixed to the other two components of the garment 10 (see FIG. 2).

In order to allow fixing of the third component 19 to the outer component 12 and/or to the second component 14, the third component 19 is provided with third fixing means 20, 29.

Said third fixing means comprise preferably fourth connection means 20 which are arranged along the sides of the front opening 26 of the third component 19 on the outer surface of the latter (see FIGS. 7, 8 and 9).

Preferably, the fourth connection means 20 consists of two rows of teeth of a zip fastener. Each row of teeth is positioned in the vicinity of one of the two edges of the front opening 26 and is designed to be fixed to another half of a corresponding zip fastener, in particular to the corresponding zip fastener half of the third connections means 16 of the second component 14 or to the corresponding zip fastener half of the first connection means 13 of the first outer component 12.

Via the fourth connection means 20 and the third connection means 16, therefore, the third component 19 may be removably fixed to the second component 14.

Similarly, via the fourth connection means 20 and the first connection means 13, therefore, the third component 19 may be removably fixed to the first outer component 12.

The third fixing means further comprise additional connection means 29 arranged at the ends of the sleeves of the third component 19.

These connection means 29 are designed to cooperate with the corresponding connection means 23 of the first outer component 12 or with the corresponding connection means 17 of the second component 14.

In this way it is possible to fix the sleeves of the third component 19 to the sleeves of the outer component 12 or to the sleeves of the second component 14, after inserting them inside them.

In the case where the third component 19 is used on its own, and therefore in the case where the fourth connection means 20 are not engaged with corresponding fixing means, the fourth connection means 20 may be advantageously housed inside a pocket 28 provided on the outer surface of the third component 19, so as to be hidden from view.

Below the possible configurations of the multi-component garment 10 according to the invention will be described.

For the sake of easier illustration, as already mentioned, reference will be made to use of the multi-component garment 10 by a motorcyclist.

Advantageously, the multi-component garment 10 according to the invention may be used in a "motorcycling configuration" or in a "non-motorcycling configuration".

On the basis of the above definitions, the multi-component garment 10 may assume two different motorcycling configurations.

Figure 5:
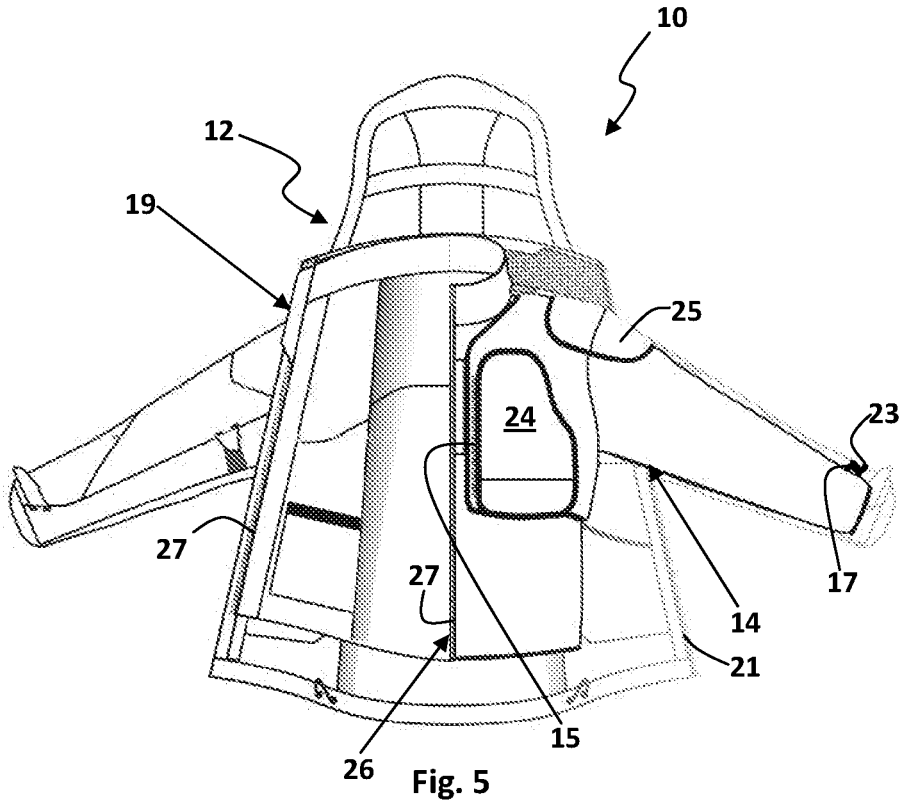
FIGS. 5, 6 and 7 show schematically different configurations of use of the multi-component garment according to the invention.

According to a first motorcycling configuration, shown in FIGS. 5, 8 and 9, the second component 14 is fixed to the first outer component 12 so as to be arranged between the latter and the third component 19.

The second protection component 14 is fixed to the outer component 12 by fixing the second connection means 15 to the first connection means 13 of the first outer component 12 (see FIG. 8). This fixing operation is extremely simple since it is performed by means of zip fastener means.

In this way, the first outer component 12 and the second component 14 of the garment 10 are fixed together in the region of the respective front openings.

Furthermore, in order to ensure firm joining together of the two aforementioned components, the fixing loops 17, 18 of the second component 14 may be fixed to the respective connection means 23 arranged on the first outer component 12.

In turn, in this first motorcycling configuration, the third thermal insulation component 19 is fixed to the second protection component 14 by fixing the fourth connection means 20 to the corresponding third connection means 16 (see FIG. 9). In this case also this fixing operation is extremely simple since it is carried out by means of zip fasteners.

In this way, with the second component 14 being fixed to the outer component 12, the third component 19 is fastened to the outer component 12.

This first motorcycling configuration, comprising the second protection component 14, on the one hand provides the motorcyclist with effective protection against knocks and falls, and on the other hand, owing to the presence of the third thermal insulation component 19, ensures effective protection of the motorcyclist against low temperatures.

At the same time, the outer component 12 protects the motorcyclist from the rain and wind.

Figure 11:
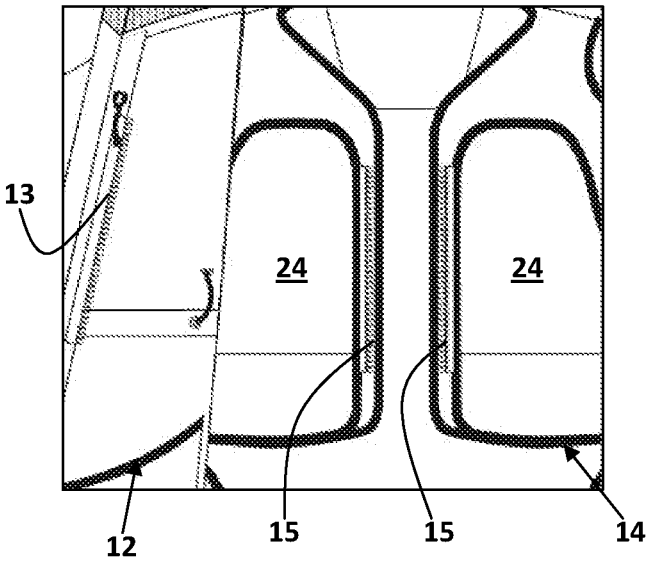
FIG. 11 shows a view, on a larger scale, of the detail indicated by B in FIG. 10.
Figure 10:
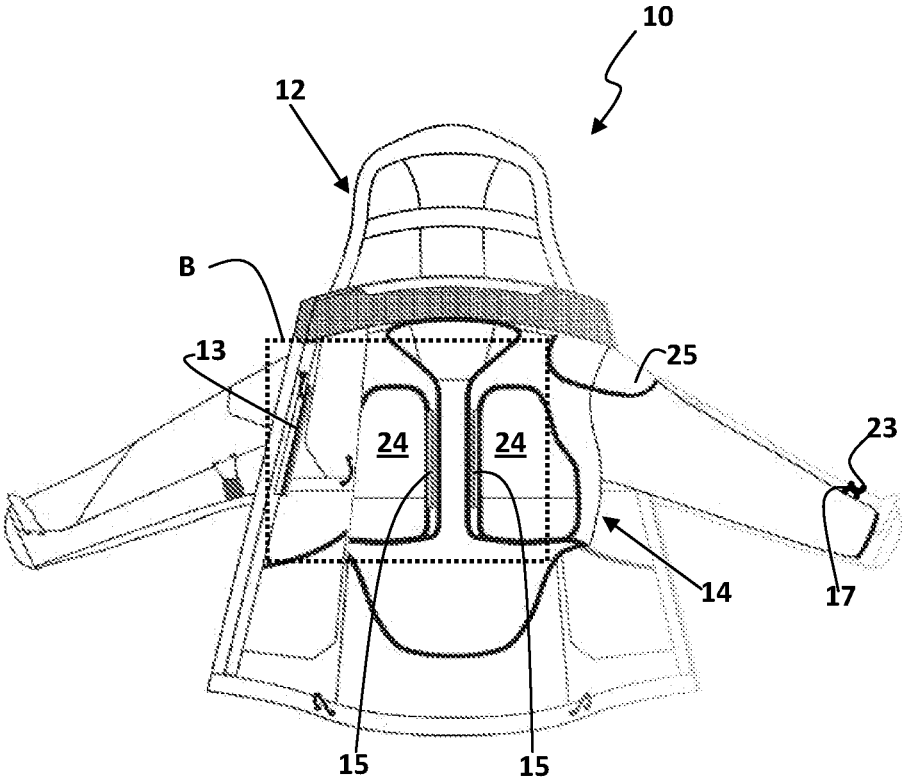
FIG. 10 shows a view, similar to that of FIG. 6, where the fixing means of the respective components of the multi-component garment according to the invention can be seen.

A second motorcycling configuration of the multi-component garment 10 is shown in FIGS. 6, 10 and 11. According to this second motorcycling configuration the second component 14 is fixed to the outer component 12 in the manner described above, but does not comprise the third thermal insulation component 19.

This second configuration provides the motorcyclist with suitable protection against knocks and falls and at the same time may be advantageously used in the case of milder outdoor temperatures.

Advantageously, the multi-component garment 10 could be used in a further motorcycling configuration comprising solely the second protection components 14 and the third thermal insulation component 19.

Once said two components have been fixed together in the manner described above, the assembly consisting of protective component 14/thermal insulation component 19 could be worn underneath a general outer component having also characteristics different from those described in connection with the outer component 12.

It would be sufficient, in fact, for the outer component to be designed in terms of wearability such that the assembly consisting of protection component 14 and thermal insulation component 19 may be housed inside it.

Advantageously, the multi-component garment 10 according to the invention may also assume three different "non-motorcycling configurations".

These non-motorcycling configurations have in common the fact that the multi-component garment 10 does not comprise the second protection component 14. These non-motorcycling configurations may be advantageously used by the user in all those circumstances where said user is not riding a motorcycle. In these configurations, the garment 10 is lighter and less bulky. Moreover, the user may not be hindered by the presence of the protection elements which prove to be superfluous if the user is not riding a motorcycle.

A first non-motorcycling configuration is shown in FIG. 7.

In this non-motorcycling configuration, the third thermal insulation component 19 is inserted inside the outer component 12 without the arrangement of the protection component 14 in between.

In this configuration, the fourth connection means 20 of the third component 19 may be connected to the first connection means 13 of the first outer component 12.

The connection means 23 of the outer component 12 positioned on the sleeves may be connected to the corresponding fixing means 29 of the third component 19. Said connection is not necessary for the garment to perform its function of providing protection against wind and rain, owing to the presence of the outer component 12, and protection against the cold, owing to the presence of the third thermal insulation component, but facilitates the garment wearing operations.

A second non-motorcycling configuration is shown in FIG. 1.

In this configuration the multi-component garment 10 comprises solely the first outer component 12. As already mentioned above, in fact, the provision of a front opening provided with independent closing means 21 allows the user to put on easily the outer component 12 and close it around his/her body, independently of the presence of other components.

This configuration is particularly suitable for the case, where there is a mild, but rainy and/or windy climate, which does not require the presence of the third thermal insulation component 19.

A third non-motorcycling configuration is shown in FIG. 2.

In this configuration the multi-component garment 10 comprises solely the third inner component 19. As already mentioned, in fact, in a similar manner to the outer component 12, the third inner component 19 may also be worn on its own. The front opening 26 provided with independent closing means 27 allows the user to close the third component 19 around his/her body, independently of the presence of other components.

This third non-motorcycling configuration is particularly suitable for the case where the user must be protected from the cold.

From the description provided above it is clear that the multi-component garment 10 according to the present invention has technical characteristics such as to solve advantageously the problems and the drawbacks of the prior art.

In particular, it is clear how the garment according to the present invention may be easily used in different configurations.

In the case of motorcycling configurations it is clear how the garment according to the invention on the one hand provides a suitable protection against knocks and falls owing to the presence of the second component 14. On the other hand, owing to the specific technical characteristics of the second component which is made for example using a thin, flexible, mesh fabric, said component may perform its protection function, without hindering the movements of the motorcyclist or making the garment 10 excessively bulky.

Furthermore, the fixing means with which the components of the garment are provided on the one hand ensure, when required, a stable connection between the various components of the garment, and, on the other hand, ensure that this connection is easy and simple to perform.

Finally, in the case where the garment is used in a non-motorcycling configuration, it is clear how the easy removal of the second component 14 allows a lighter and more comfortable garment to be rapidly obtained, encouraging the user to wear this garment even when he/she is not riding a motorcycle.

The person skilled in the art may make modifications to the embodiments of the multi-component garment described above and/or replace elements described with equivalent elements, without thereby departing from the scope of the accompanying claims.

For example, fixing means and connection means different from, but equivalent to those shown in the accompanying figures, may be used. For example the zip fasteners, loops and fixing elements may be replaced by snap-fit fasteners or ring-eyelet fastening means of the Velcro® type.

The invention claimed is:

1. A multi-component garment comprising:

a first outer component provided with first fixing means;

a second inner component for providing protection against one or both of knocks and falls, and provided with second fixing means; and a third inner thermal insulation component provided with third fixing means;

wherein the second inner component comprises seats to house one or both of removably protective padding elements and semi-rigid protection elements;

wherein the first fixing means, the second fixing means and the third fixing means comprise cooperative connection means with which the first outer component is removably fixed directly to the second inner component and the second inner component is removably fixed directly to the third inner thermal insulation component in a first configuration of the garment; and wherein a connector of the first fixing means is connected to a connector of the second fixing means in a second configuration of the garment in which the first outer component is removably fixed directly to the second inner component and in a third configuration of the garment the same connector of the first fixing means is connected to a connector of the third fixing means whereby the first outer component is removably fixed directly to the third inner thermal insulation component.

2. The multi-component garment according to claim 1, wherein the second inner component is positioned between the first outer component and the third inner component in the first configuration of the garment.

3. The multi-component garment according to claim 1, wherein one of the connection means of the second fixing means are arranged on an outer surface of the second inner component, along sides of a front opening of the second inner component.

4. The multi-component garment according to claim 3, wherein one of the connection means of the first fixing means are arranged on an inner surface of the first outer component, along sides of a front opening of the first outer component, and wherein the one connection means of the second fixing means are removably fixed to the one connection means of the first fixing means.

5. The multi-component garment according to claim 4, wherein further of the connection means of the first fixing means are positioned on sleeves of the first inner component, said further connection means removably fixable to corresponding further of the connection means of the second outer component.

6. The multi-component garment according to claim 5, wherein even further connection means of the first fixing means are positioned on a shoulder and a neck of the first inner component, said even further connection means removably fixable to corresponding even further of the connection means of the second outer component.

7. The multi-component garment according to claim 4, wherein further of the connection means of the first fixing means are positioned on a shoulder and a neck of the first inner component, said further connection means removably fixable to corresponding further of the connection means of the second outer component.

8. The multi-component garment according to claim 1, wherein one of the connection means of the first fixing means are arranged on an inner surface of the first outer component, along sides of a front opening of the first outer component.

9. The multi-component garment according to claim 8, wherein one of the connection means of the third fixing means are arranged on an outer surface of the third inner component, along sides of a front opening of the third inner component, and wherein the one connection means of the first fixing means are removably fixed to the one connection means of the third fixing means.

10. The multi-component garment according to claim 9, wherein further of the connection means of the third fixing means are positioned on sleeves of the third inner component, said further connection means removably fixable to corresponding further of the connection means of the first outer component or of the second inner component.

11. The multi-component garment according to claim 1, wherein one of the connection means of the second fixing means are arranged on an inner surface of the second inner component, along the sides of a front opening of the second inner component.

12. The multi-component garment according to claim 11, wherein one of the connection means of the third fixing means are arranged on an outer surface of the third inner component, along sides of a front opening of the third inner component, and wherein the one connection means of the second fixing means are removably fixed to the one connection means of the third fixing means.

13. The multi-component garment according to claim 1, wherein one of the connection means of the third fixing means are arranged on an outer surface of the third inner component, along sides of a front opening of the third inner component.

14. The multi-component garment according to claim 1, wherein one of the connection means of the third fixing means are positioned on sleeves of the third inner component, said one connection means removably fixable to corresponding one of the connection means of the first outer component or of the second inner component.

15. The multi-component garment according to claim 14, wherein the one connection means and the corresponding one connection means of the first outer component or the second inner component comprise releasable strips, said releasable strips being provided with releasable closing means so as to be insertable inside corresponding fixing rings.

16. The multi-component garment according to claim 1, wherein the second inner component is made using a flexible fabric.

17. The multi-component garment according to claim 16, wherein the second inner component is made using a mesh fabric.

18. The multi-component garment according to claim 16, wherein the flexible fabric has a thickness of less than 1 mm.

19. The multi-component garment according to claim 1, wherein said seats are arranged respectively on portions of the second inner component to be positioned, during use, over a back and a torso of a user, over elbows and shoulders of the user, or over the back, the torso, the elbows, and the shoulders of the user.

20. The multi-component garment according to claim 1, wherein the third inner component is made using a dual-layer synthetic fabric padded with one or more of wadding and feathers.

* * * * *